US005845188A

United States Patent [19]

Fujii et al.

[11] Patent Number: 5,845,188

[45] Date of Patent: Dec. 1, 1998

[54] IMAGE FORMING DEVICE

[75] Inventors: Michihiro Fujii, Kato-gun; Masato Kawashima, Kawasaki, both of Japan

[73] Assignee: Fujitsu Limited, Kawasaki, Japan

[21] Appl. No.: 679,567

[22] Filed: Jul. 15, 1996

[30] Foreign Application Priority Data

Dec. 22, 1995 [JP] Japan ..... 7-335532

[51] Int. Cl.[6] ..... G03G 15/00; G03G 15/01

[52] U.S. Cl. ..... 399/390; 399/388; 399/299; 399/303

[58] Field of Search ..... 399/388, 390, 399/303, 299, 306, 316, 312, 396

[56] References Cited

U.S. PATENT DOCUMENTS

| | | | |
|---|---|---|---|
| 3,642,362 | 2/1972 | Mueller | 399/312 |
| 5,041,877 | 8/1991 | Matsumoto | 399/66 |
| 5,089,851 | 2/1992 | Tanaka et al. | 399/176 |
| 5,140,375 | 8/1992 | Shindo et al. | 399/45 |
| 5,153,653 | 10/1992 | Fuma et al. | 399/312 |
| 5,172,172 | 12/1992 | Amemiya et al. | 399/303 |
| 5,249,022 | 9/1993 | Watanabe et al. | 399/303 |
| 5,321,477 | 6/1994 | Nagata et al. | 399/312 |
| 5,335,052 | 8/1994 | Sato et al. | 399/312 |
| 5,602,633 | 2/1997 | Yoshida et al. | 399/244 |
| 5,629,760 | 5/1997 | Hayashi et al. | 399/312 |
| 5,678,138 | 10/1997 | Kobayashi et al. | 399/388 X |

FOREIGN PATENT DOCUMENTS 4-149570 5/1992 Japan .

*Primary Examiner*—Matthew S. Smith

*Attorney, Agent, or Firm*—Armstrong, Westerman, Hattori, McLeland, & Naughton

[57] ABSTRACT

An image forming device that can surely prevent a flutter of a sheet-like medium in the feeding portion even when there is a difference in velocity between the conveying belt and the front conveying system at the time of feeding a sheet-like medium onto the conveying belt, thereby obtaining a high-quality image. The image forming device includes a pressure roller mounted in an idle mode on the conveying belt and near to the portion where the transfer paper is fed from the conveying system, the transfer paper being transferred from the conveying system onto the conveying belt while being sandwiched between the pressure roller and the conveying belt. The image forming device is applicable to printers of electro-photographic system, electro-static recording system, or the like.

4 Claims, 10 Drawing Sheets

IMAGE FORMING DEVICE

BACKGROUND OF THE INVENTION

1) Field of the Invention

The present invention relates to an image forming device of an electro-photographic system, electro-static recording system, or the like. Particularly, the present invention relates to an image forming device that forms an image on a sheet-like medium by transferring an image such as a developed image (toner image) formed on the surface of a latent image carrier such as a photosensitive body on a sheet-like medium conveyed by a conveying belt.

2) Description of the Related Art

Electro-photographic printers as image forming devices, for example, have generally the structure as shown in FIG. 8. The electro-photographic printer 1 shown in FIG. 8 consists of a color printing engine 2, paper cassettes 3 and 4, a sheet feeding unit 5, a sheet ejecting unit 6, a sheet stacker 7, a power supply/control unit 8, and others.

In the electro-photographic printer 1, the transfer paper (sheet-like medium, sheet) 18 to be printed are stored in the sheet cassettes 3 and 4. At the time of printing, the transfer paper 18 is sent out of the sheet feeding unit 5 and then guided by means of the conveying roller 23 along the conveying guide (transfer path) 24 to the color printing engine 2. The transfer paper 18 which is color-printed by the color printing engine 2 (to be described later) is guided via the conveying guide (conveying path) 24 and the sheet ejecting unit 6 and then ejected into the sheet stacker 7.

The power supply/control unit 8 has the function of supplying electric power for the operation of the printer 1 to various portions and controlling the whole operation of the printer 1 including the printing operation of the color printing engine 2.

The printer 1 shown in FIG. 8 includes a double-sided surface mechanism (not shown) that reverses the transfer paper 18 with one surface printed to the side of the sheet ejecting unit 6 to perform a double-sided surface printing on the transfer paper 18 and a conveying guide (conveying path) 24A that again sends the transfer paper 18 reversed by the double-sided mechanism to the color printing engine 2.

Generally speaking, the color printing engine 2 which performs a color image printing operation includes four printing units 10Y, 10M, 10C, and 10K, a fixing unit 16, an endless electrostatic adsorption belt (conveying belt, transfer belt) 17 of a resin which conveys the transfer paper 18.

The printing unit 10Y is formed of a photosensitive body (transfer drum, latent image carrier) 11, a front charger 12, an optical unit 13, a developing unit 14, and a transfer roller 15 in order to transfer a toner image of yellow (Y) on the transfer paper 18. The printing unit 10M is formed of a photosensitive body (transfer drum, latent image carrier) 11, a front charger 12, an optical unit 13, a developing unit 14, and a transfer roller 15 in order to transfer a toner image of magenta (M) on the transfer paper 18. The printing unit 10C is formed of a photosensitive body (transfer drum, latent image carrier) 11, a front charger 12, an optical unit 13, a developing unit 14, and a transfer roller 15 in order to transfer a toner image of cyan (C) on the transfer paper 18. The printing unit 10K is formed of a photosensitive body (transfer drum, latent image carrier) 11, a front charger 12, an optical unit 13, a developing unit 14, and a transfer roller 15 in order to transfer a toner image of black (B) on the transfer paper 18. The printing units 10Y, 10M, 10C and 10K are arranged nearly in parallel along the electrostatic adsorption belt 17.

The photosensitive body 11 is rotatably driven by means of a drive motor (not shown). The front charger 12 charges evenly the surface of the photosensitive body 11. The optical unit 13 projects an image light corresponding to recording information (information regarding print data) on the surface of the photosensitive body 11. The optical unit 13 exposes a pattern corresponding to print data on the surface of the photosensitive body 11 to form an electrostatic latent image.

The developing unit 14 develops the electrostatic latent image formed on the surface of the photosensitive body 11. In fact, the developing process is performed by supplying toner on the surface of the photosensitive body 11 and then forming a toner image (latent image, developing image) which is visible. The transfer rollers 15 are arranged so as to confront the photosensitive bodies 11, thus sandwiching the electrostatic adsorption belt (or the transfer paper 18) 17. The toner image on the photosensitive body 11 is transferred onto the transfer paper 18 by sandwiching the transfer paper 18 conveyed by the electrostatic adsorption belt 17 between the transfer roller 15 and the photosensitive body 11.

Further, when the transfer paper 18 on which a toner image of each color is transferred by means of the printing units 10Y, 10M, 10C and 10K is conveyed, the fixing unit 16 fixes the toner image formed on the transfer paper 18 onto the transfer paper 18 thermally, or under pressure, lighting, or the like.

The electrostatic adsorption belt 17 is endlessly wound around the drive roller 19, the following roller 20, and tensioning rollers (tensioners) 21 and 22, and is driven by transmitting the rotational drive force of the drive motor (refer to numeral 25 in FIG. 9) by means of the drive roller 19. The transfer paper 18 which is electrically charged by means of the corona charger (refer to numeral 26 in FIG. 9) is electrostatistically adsorbed on the outer surface (the surface confronting the photosensitive body 11) and then is conveyed sequentially to the printing units 10Y, 10M, 10C and 10K.

In order to arrange in order the front ends of plural sheets of transfer paper 18, the resist roller (not shown) is arranged just in front of the image transfer point (the image transfer point made by the photosensitive body 11 and the transfer roller 15) of the transfer paper 18 in each of the printing units 10Y, 10M, 10C and 10K.

In the electro-photographic printer 1 with the above-mentioned structure shown in FIG. 8, the transfer paper 18 is transmitted from the sheet cassette 3 or 4 onto the transfer belt 17 of the color printing engine 2 via the sheet feeding unit 5. Then the transfer belt 17 transmits the transfer paper 18 to the fixing unit 16 by passing through the printing units 10Y, 10M, 10C and 10K.

While the transfer paper 18 passes through the printing units 10Y, 10M, 10C and 10K, a toner image of each color (Y, M, C, K) is transferred on the transfer paper 18. While the transfer paper 18 passes through the fixing unit 16, the toner image is fixed on the transfer paper 18.

When a printing operation is performed by overlaying sequentially different colors on the transfer paper 18 in the printing units 10Y, 10M, 10C and 10K, a color image is formed on the transfer paper 18.

The sheet conveying velocity of the electrostatic adsorption belt 17 is set to the same as that of the conveying roller 23 arranged upstream to the electrostatic adsorption belt 17. However, it is very difficult to match completely two sheet conveying velocities to each other because of the accuracy in dimension of the constituent member of the eletrostatic adsorption belt 17, the accuracy in dimension of the pair of the conveying rollers 23, the accuracy in revolution of the drive motor (refer to numerals 25 and 30 in FIG. 9) for the drive roller 19 or the conveying roller 23, wear of the conveying roller 23, and others.

When two sheet conveying velocities do not match to each other, bending and fluttering occur in the transfer paper 18 at the portion where the transfer paper 18 is transmitted from the conveying system including the conveying roller 23 to the conveying system including the electrostatic adsorption belt 17. The fluttering causes the unstable state of the transfer paper 18 at the image transfer point of each of the printing units 10Y, 10M, 10C and 10K, thus occurring the shear and variation in printing due to the printing units 10Y, 10M, 10C and 10K. As a result, the printing accuracy is deteriorated.

Further, it has been proposed that the conveying system 32, for example, shown in FIG. 9 is prepared in the front stage of the color printing engine 2 to convey the transfer paper 18 at high speed. That is, the conveying system 32 includes conveying rollers 28 and 29 which are driven at high speed by means of the drive motor 30. The conveying rollers 28 and 29 convey the transfer paper 18 immediately before the color printing unit 2 (the conveying system including the electrostatic adsorption belt 17).

The clutch 31 is arranged between the conveying roller 28 arranged just before the color printing unit 2 and the drive motor 30. The problem of the difference in velocity between the conveying system including the electrostatic adsorption belt 17 and the conveying system 32 can be eliminated by coupling on or off the clutch 31 while the transfer paper 18 is conveyed at a high speed. The drive motor 25 which drives the electrostatic adsorption belt 17 belongs to a different system from the conveying system 32 including the drive motor 30. The drive motors 25 and 30 drive respectively the conveying systems at completely different speed.

That is, with the clutch 31 coupled, the conveying rollers 28 and 29 feed the transfer paper 18 into the color printing unit 2. When the rear end of the transfer paper 18 passes through the position of the conveying roller 29, the clutch 31 is coupled off so that the conveying roller 28 is changed in its idle mode. At this time, the front end of the transfer paper 18 reaches the upper surface of the electrostatic adsorption belt 17. Thereafter, the transfer paper 18 is fed at the conveying speed of the conveying system including the electrostatic adsorption belt 17. The conveying roller 28 also co-rotates at the conveying speed.

Referring to FIG. 9, numeral 26 represents a corona charger. In the color printing engine 2, the corona charger 26 is arranged near to the portion where the sheet-like medium 18 is fed from the conveying system 32 and charges the transfer paper 18 fed onto the electrostatic adsorption belt 17 to be adsorbed on the electrostatic adsorption belt 17. The corona charger 26 is not illustrated in FIG. 8.

However, compared with the example described with FIG. 8, it is more difficult to eliminate completely the problem of the difference in velocity between the conveying system including the electrostatic adsorption belt 17 and the conveying system 32 even if the clutch 31 is coupled on or off.

For example, when the conveying speed of the pair of the conveying rollers 23 or 28 is smaller than that of the electrostatic adsorption belt 17, the pair of the conveying rollers 23 or 28 pulls relatively the rear portion of the transfer paper 18. This phenomenon causes the positional displacement of the transfer paper 18 to the electrostatic adsorption belt 17. The phenomenon also may cause the transfer failure due to the deformation of the electrostatic adsorption belt 17 shown in FIG. 10(*a*) as well as the displacement in transfer position between the toner image of the first color and the toner image of the second color. Moreover, at the moment when the end of the transfer paper 18 has passed through the pair of the conveying rollers 23 or 28, the electrostatic adsorption belt 17 can be quickly recovered. Hence, the shocking operation may cause transfer variations.

When the conveying speed of the pair of the conveying rollers 23 or 28 is larger than that of the electrostatic adsorption belt 17, the pair of the conveying rollers 23 or 28 pushes out the rear portion of the transfer paper 18 relatively. Therefore, since the electrostatic adsorption belt 17 may deform or the transfer paper 18 is lifted from the electrostatic adsorption belt 17 as shown in FIG. 10(*b*), the before-mentioned troubles occur.

This problem becomes more remarkable in the case of a large-sized transfer paper 18. Further, the problem become a significant demerit in the copier market demanding high-quality images, particularly in the color copier market demanding the improved color reproducibility. The positional shear of the transfer paper 18 on the electrostatic adsorption belt 17 may cause jamming when an adsorption failure or adsorption jam induces or the transfer paper is peeled from the electrostatic adsorption belt 17 in the post process.

SUMMARY OF THE INVENTION

The present invention is made to overcome the above mentioned problems. An object of the present invention is to provide an image forming device that can surely prevent a flutter of the sheet-like medium in the feeding portion even when there is a small difference in velocity between the conveying belt and the pre-conveying system at the time of feeding a sheet-like medium acting as a transfer paper onto the conveying belt, whereby a high-quality image can be obtained without causing any transfer failure, jam, or the like.

In order to achieve the above objects, according to the present invention, the image forming device is characterized by a printing unit for performing a printing operation on a sheet-like medium by transferring a developed image on the sheet-like medium at an image transfer point; a conveying belt for conveying the sheet-like medium along a conveying path formed so as to pass over the image transfer point by means of the printing unit; a conveying system for conveying the sheet-like medium on the conveying belt; a driving system for respectively driving the conveying belt and the sheet-like medium by means of different drive systems; and a pressure roller mounted in an idle mode on the conveying belt and near to the portion where the sheet-like medium is fed from the conveying system, the sheet-like medium being transferred from the conveying system onto the conveying belt while being sandwiched between the pressure roller and the conveying belt.

Each of plural printing units is arranged for each of plural colors to form a color image by overlaying the plural colors; and the conveying belt conveys the sheet-like medium along a conveying path to perform continuously a printing operation on the sheet-like medium by means of each of the printing units, the conveying path being formed so as to pass over the image transfer point by means of each of the printing units.

Further, the image forming device includes a power supply for supplying electric power to said pressure roller;

and the pressure roller acts as a charger that electrically charges the sheet-like medium.

As described above, even when there is somewhat a difference in velocity between the conveying belt and the pre-conveying system, the fluttering of a sheet-like medium can be certainly prevented in the feeding portion by feeding a sheet-like medium from the conveying system onto the conveying belt while being sandwiched between the pressure roller and the conveying belt.

As described above, the image forming device according to the present invention has the advantage of forming high-quality images without producing any transfer failure or jamming since the fluttering of a sheet-like medium can be certainly prevented in the feeding portion by feeding a sheet-like medium from the conveying system onto the conveying belt while being sandwiched between the pressure roller and the conveying belt.

Particularly, when a color image is formed by overlaying plural colors with a printing unit for each color, high-quality images can be formed without any color shift.

Since the pressure roller acts as a charger that electrically charges the sheet-like medium, it is not needed to arrange another charger that makes the conveying belt to adsorb the sheet-like medium. This feature contributes to the device configuration simplified and slimmed.

BRIEF DESCRIPTION OF THE DRAWINGS

FIG. 10(*b*) is a diagram used for explaining that an operation status occurs due to the difference in velocity between a conveying system using an electrostatic adsorption belt and another conveying system.

DESCRIPTION OF THE PREFERRED EMBODIMENTS

Let us explain an embodiment of the present invention with reference to the attached drawings.

Figure 1:
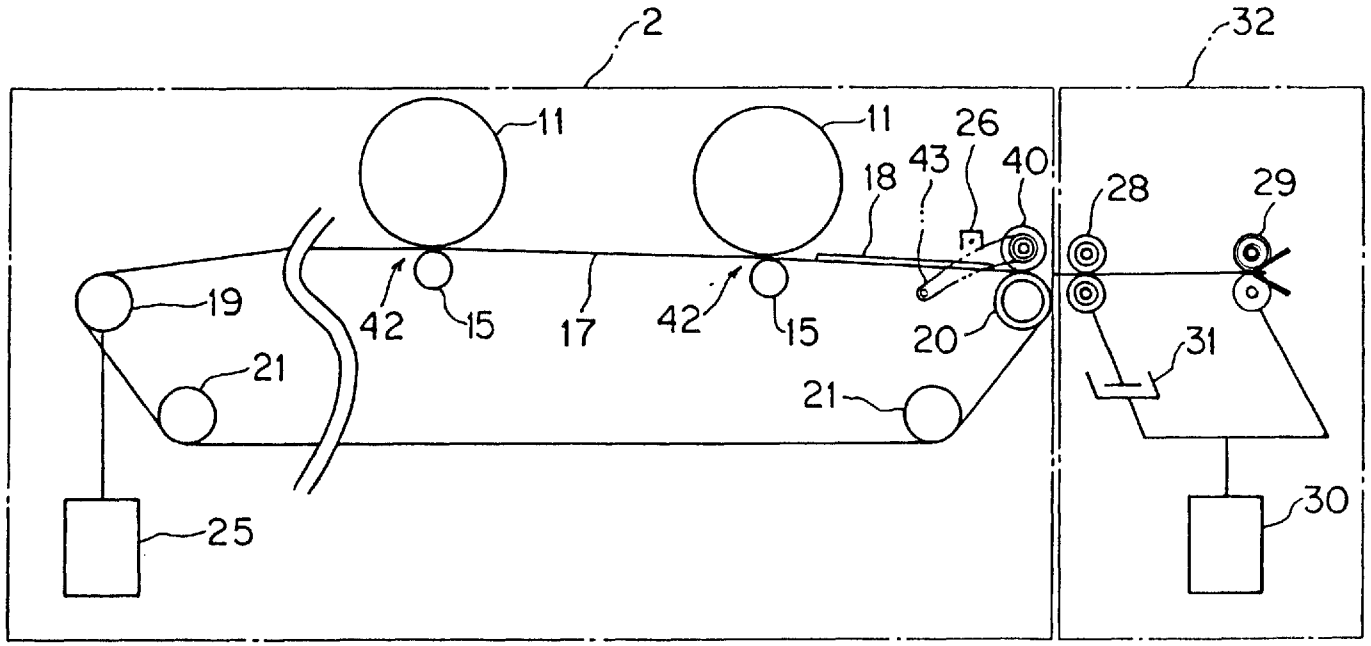
FIG. 1 is a side sectional view schematically showing the main portion of an image forming device according to an embodiment of the present invention.

FIG. 1 is a side-sectional view schematically illustrating the major portion of an image forming device as an embodiment of the present invention. The image forming device according to the present embodiment relates to the electrophotographic printer 1 before-mentioned with FIG. 8. The main portion (the feature of the present invention) shown in FIG. 1 has nearly the same configuration as the example including the conveying system 32 shown in FIG. 9. Hence, in FIGS. 1 to 7, like elements represented with like numerals shown in FIGS. 8 and 9. The detailed explanation of the same elements will be omitted here.

Figure 8:
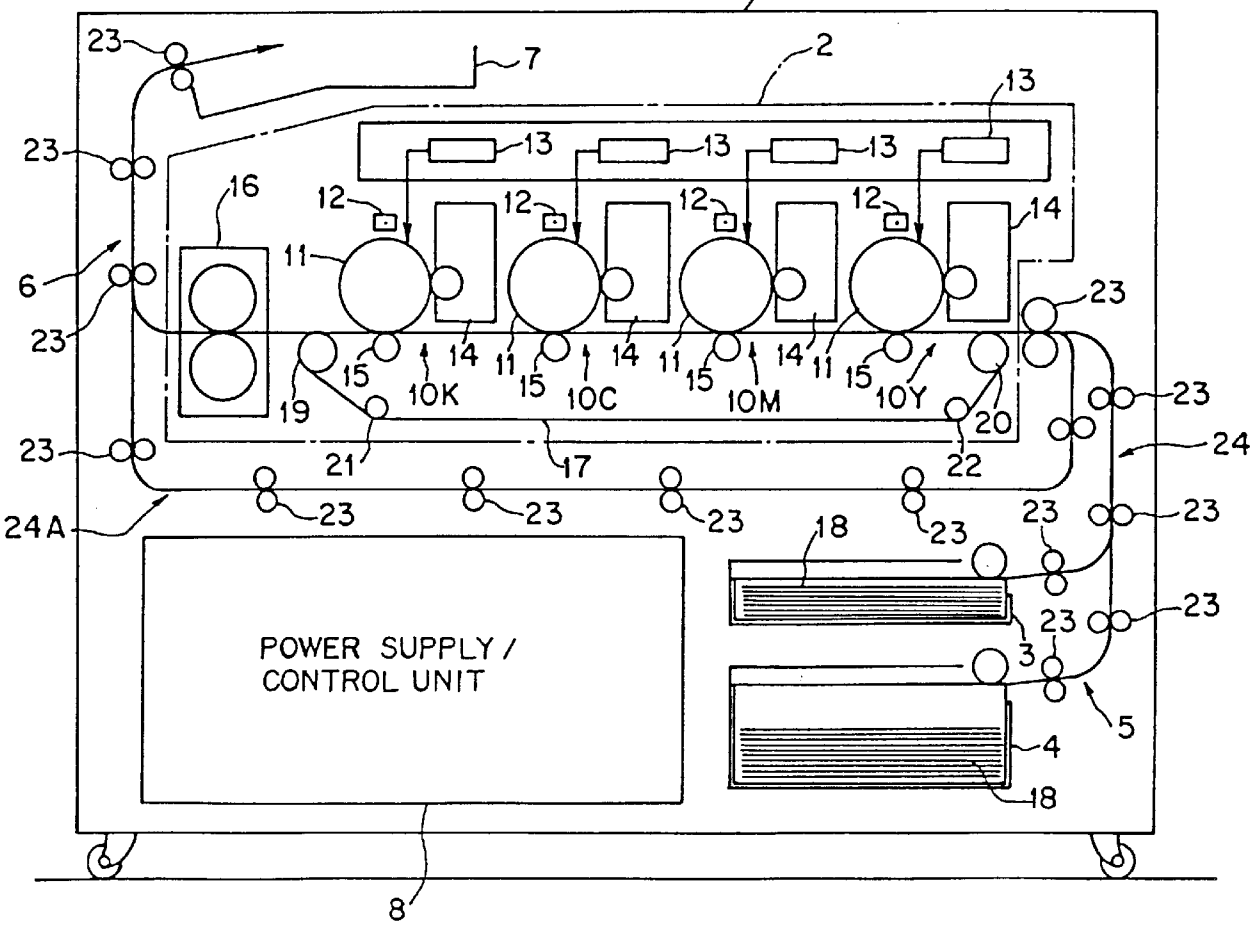
FIG. 8 RELATED ART
FIG. 8 is a side sectional view schematically showing the internal structure of a general image forming device.
Figure 9:
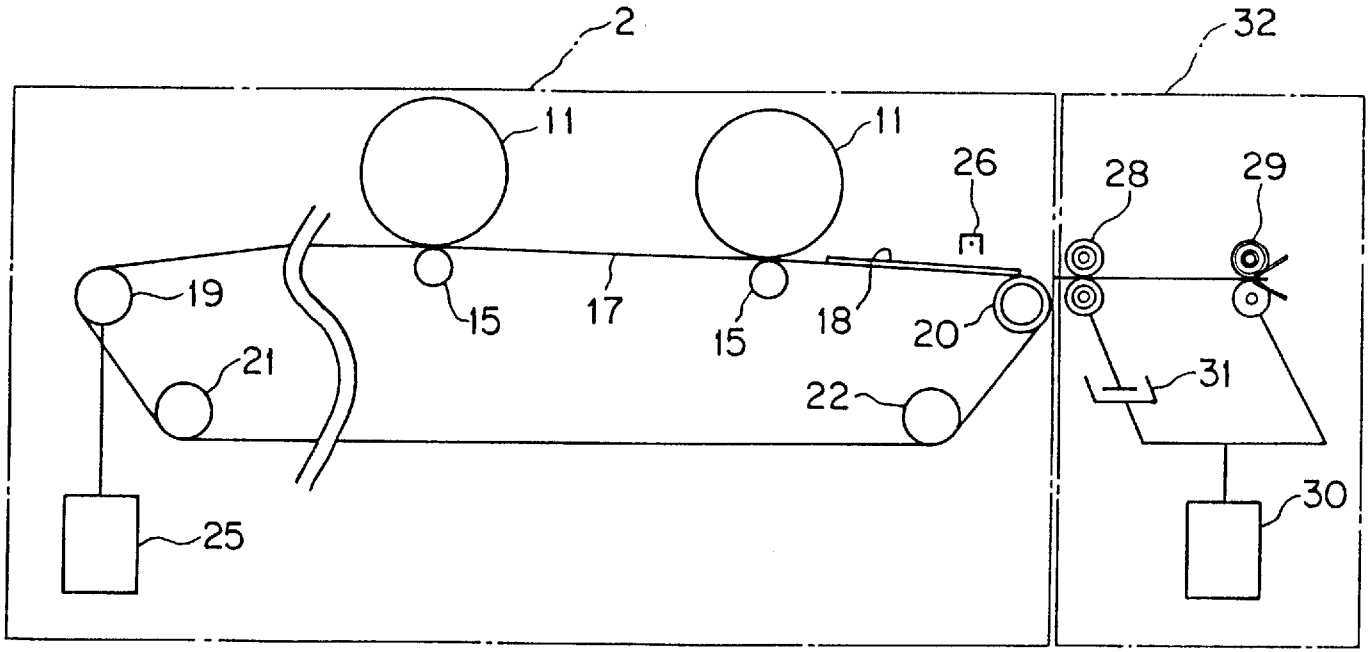
FIG. 9 RELATED ART
FIG. 9 is a side sectional view schematically showing the main portion of a general image forming device having a high-speed sheet conveying system.

As depicted in FIG. 1, the color printing engine 2 includes four printing units 10Y, 10M, 10C and 10K (refer to FIG. 8). Each of the printing units 10Y, 10M, 10C and 10K transfers a toner image onto the transfer paper (sheet-like medium) 18 at the image transfer point 42 formed between the photosensitive body 11 and the transfer roller 15. In FIG. 1, the photosensitive body 11 and the transfer roller 15 in each of the printing units 10Y and 10M are illustrated, but other corresponding portions are omitted.

In order to perform the continuous printing operation of the printing units 10Y, 10M, 10C and 10K to the transfer paper 18, the electrostatic adsorption belt 17 acting as a conveying belt feeds the transfer paper 18 along the endless conveying path passing through the image transfer points 42 of the printing units 10Y, 10M, 10C and 10K.

The electrostatic adsorption belt 17, as described before, is wound endlessly around the drive roller 19, the following roller 20 and the tension rollers (tensioners) 21 and 22. The electrostatic adsorption belt 17 is driven by the revolution drive force of the drive motor (drive system) 25 transmitted via the drive roller 19 to feed sequentially the transfer paper 18 onto its outer surface (the surface confronting the photosensitive body 11) to the printing units 10Y, 10M, 10C and 10K.

Further, in the color printing engine 2, the corona charger 26 is arranged adjacent to the portion where the sheet-like medium 18 is transmitted from the conveying system 32. The corona charger 26 electrically charges the transfer paper 18 to adsorb the transfer paper 18 sent onto the electrostatic adsorption belt 17.

A conveying system 32 is arranged in the front stage of the color printing engine 2 to feed the transfer paper 18 to the electrostatic adsorption belt 17 at a high speed. Like the system shown in FIG. 9, the conveying system 32 includes conveying rollers 28 and 29 which are rotatably driven at a high speed by means of the drive motor (drive system) 30. The transfer paper 18 is conveyed immediately before the color printing unit 2 (the conveying system including the electrostatic adsorption belt 17) by means of the conveying rollers 28 and 29.

A clutch 31 is arranged between the conveying roller 28 arranged just before the color printing engine 2 and the drive motor 30. The clutch 31 is coupled on or off according to the procedure explained with FIGS. 2 to 5 when the transfer paper 18 is fed from the conveying system 32 to the system including the electrostatic adsorption belt 17. The drive motor 25 to drive the electrostatic adsorption belt 17 belongs to a system completely different from the conveying system 32 including the drive motor 30. The drive motor 35 drives respectively the conveying systems at completely different speeds.

In the present embodiment, a pressure roller (a following roller) 40 is mounted in a freely movable state on the electrostatic adsorption belt 17 and near to the portion where the transfer paper 18 is fed from the conveying system 32 and at the position which it confronts the following roller 20 on the upper side to the corona charger 26. The system is constructed such that the transfer paper 18 is fed from the conveying system 32 onto the electrostatic adsorption belt 17 while it is sandwiched between the pressure roller 40 and the electrostatic adsorption belt (following roller 20) 17.

The pressure roller 40 is supported on one end of the lever member 43 (member shown with chain double-dashed lines in FIG. 1), with its both sides being in rotatable state. The other end of the lever member 43 is rotatably supported to the side plate (not shown) which supports rotatably on both ends of the drive roller 19 and the following roller 20. The lever member 43 can rock. The pressure roller 40 is always pressed against the electrostatic adsorption belt (following roller 20) 17 by its weight and rocks somewhat with the lever member 43 according to the thickness of the transfer paper 18 fed from the conveying system 32.

The operation of the present embodiment with above-mentioned structure will be explained below by referring to FIGS. 2 to 5, together with the on/off procedure of the clutch 31.

Figure 2:
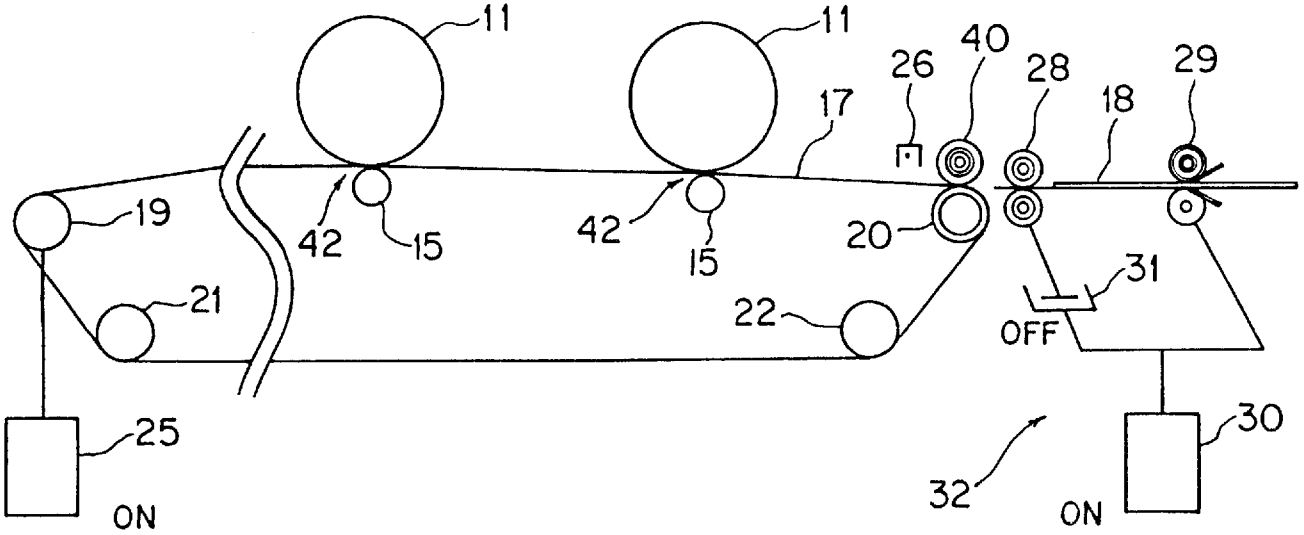
FIG. 2 is a side sectional view schematically showing the main portion of an image forming device to explain the operation of a present embodiment.

As shown in FIG. 2, before reaching the conveying roller 28, the transfer paper 18 is conveyed by driving the conveying roller 29 by means of the motor 30, with the clutch 31 coupled off.

Figure 3:
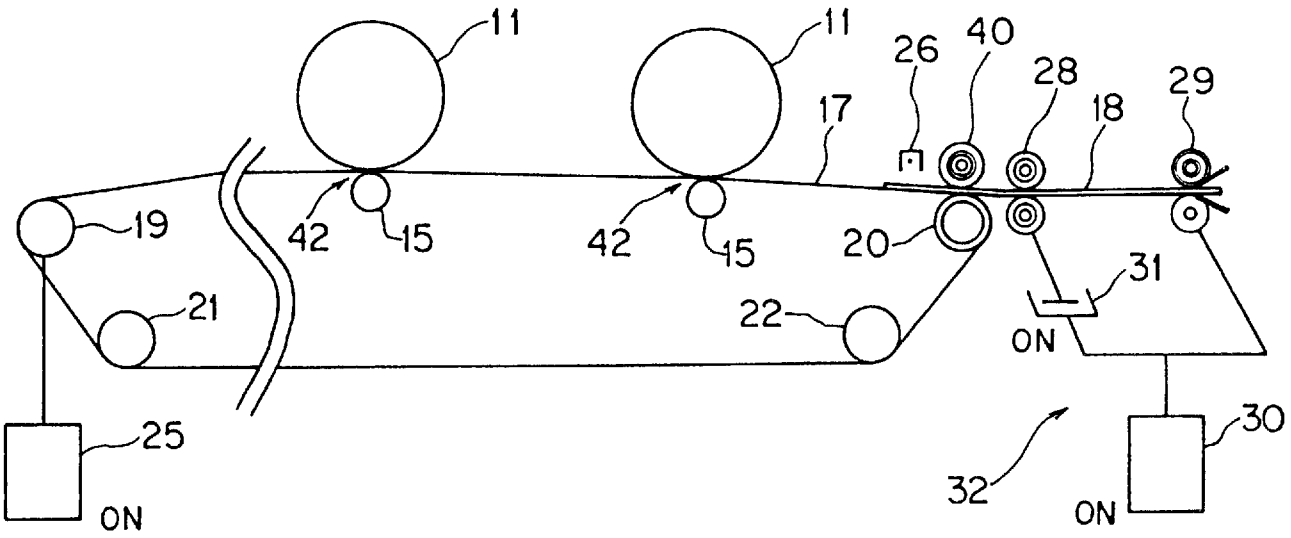
FIG. 3 is a side sectional view schematically showing the main portion of an image forming device to explain the operation of present embodiment.

As shown in FIG. 3, when the transfer paper 18 reaches the conveying roller 28, the clutch 31 is changed to its on state so that the motor 30 drives the conveying rollers 28 and 29 to feed the transfer paper 18. In such a state, the transfer paper 18 is fed out from the conveying system 32 to the electrostatic adsorption belt 17 while the end portion for the transfer paper 18 is sandwiched between the pressure roller 40 and the electrostatic adsorption roller (following roller 20) 17. At this time, the transfer paper 18 is electrically charged by means of the corona charger 26 and then adsorbed on the electrostatic adsorption belt 17.

Figure 4:
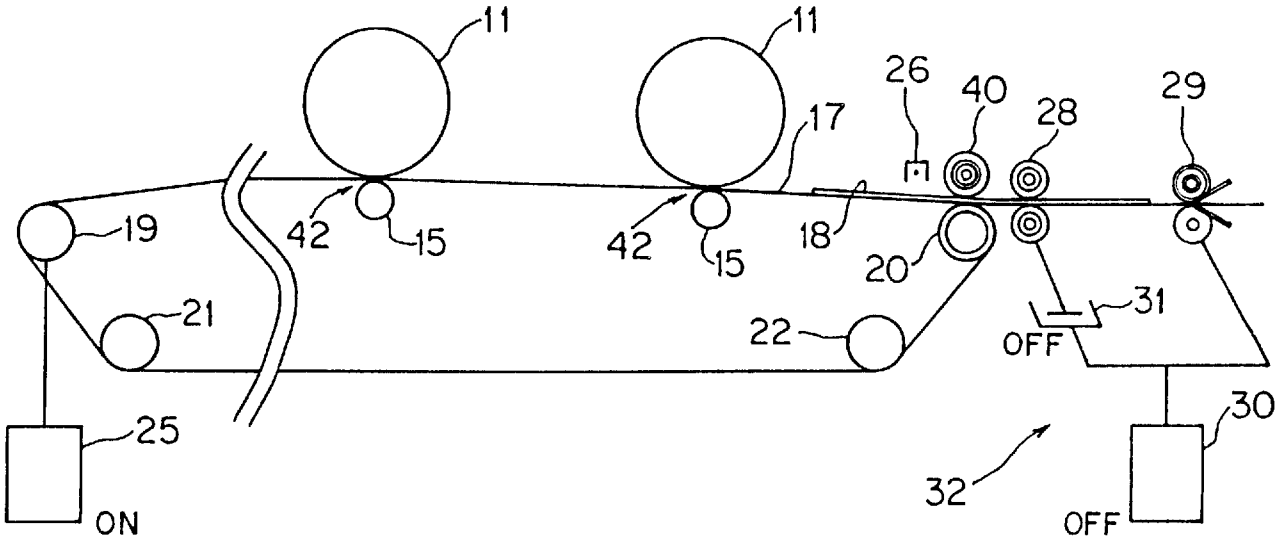
FIG. 4 is a side sectional view schematically showing the main portion of an image forming device to explain the operation of a present embodiment.
Figure 5:
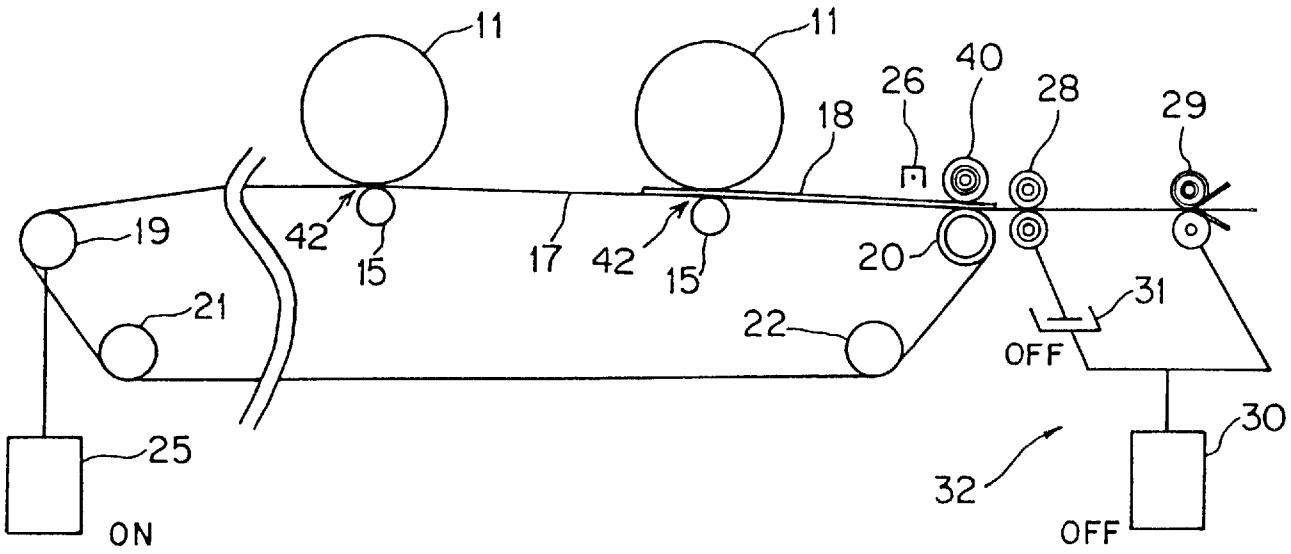
FIG. 5 is a side sectional view schematically showing the main portion of an image forming device to explain the operation of a present embodiment.

As shown in FIG. 4, the conveying roller 28 becomes an idle mode by switching the clutch 31 and the drive motor 30 to off state at the time when the rear end of the transfer paper 18 passes through the position of the transfer roller 29. Thereafter, the transfer paper 18 is conveyed at the conveying velocity of the conveying system including the electrostatic adsorption belt 17. While the conveying roller 28 is co-rotated at its conveying speed, the transfer paper 18 is fed onto the electrostatic adsorption belt 17, as shown in FIG. 5.

Figure 10A:
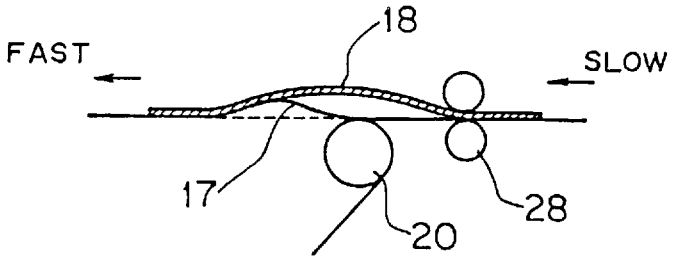
FIG. 10(a) PRIOR ART
FIG. 10(*a*) is a diagram used for explaining that an operation status occurs due to the difference in velocity between a conveying system using an electro-static adsorption belt and another conveying system.
Figure 10B:
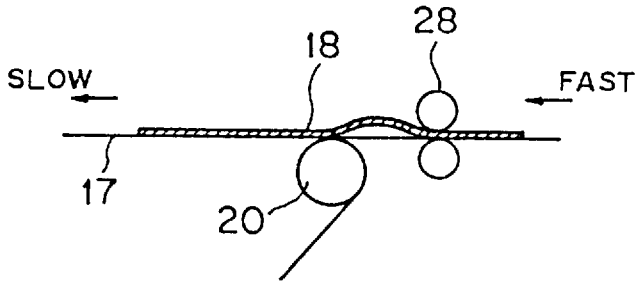
FIG. 10(b) PRIOR ART

Since the transfer paper 18 is sandwiched between the pressure roller 40 and the electrostatic adsorption roller 17 (the following roller 20), the deformation of the electrostatic adsorption belt 17 and the positional shift and fluttering of the transfer paper 18, as shown in FIGS. 10(*a*) and 10(*b*), can be surely prevented. Consequently, since the motion of the transfer paper 18 can be stable, it is eliminated that the component of the difference in velocity between the conveying system including the electrostatic belt 17 and the conveying system 32 is transferred at the image transfer point 42.

As a result, a high-quality image can be formed without bringing about the transfer failure or jamming. Particularly, in the case of the formation of a color image, the positional shift of a toner image of each color can be surely suppressed by overlaying toner images of colors used in the printing units 10Y, 10M, 10C and 10K. Thus a high-quality color image with no color shift can be formed.

Figure 6:
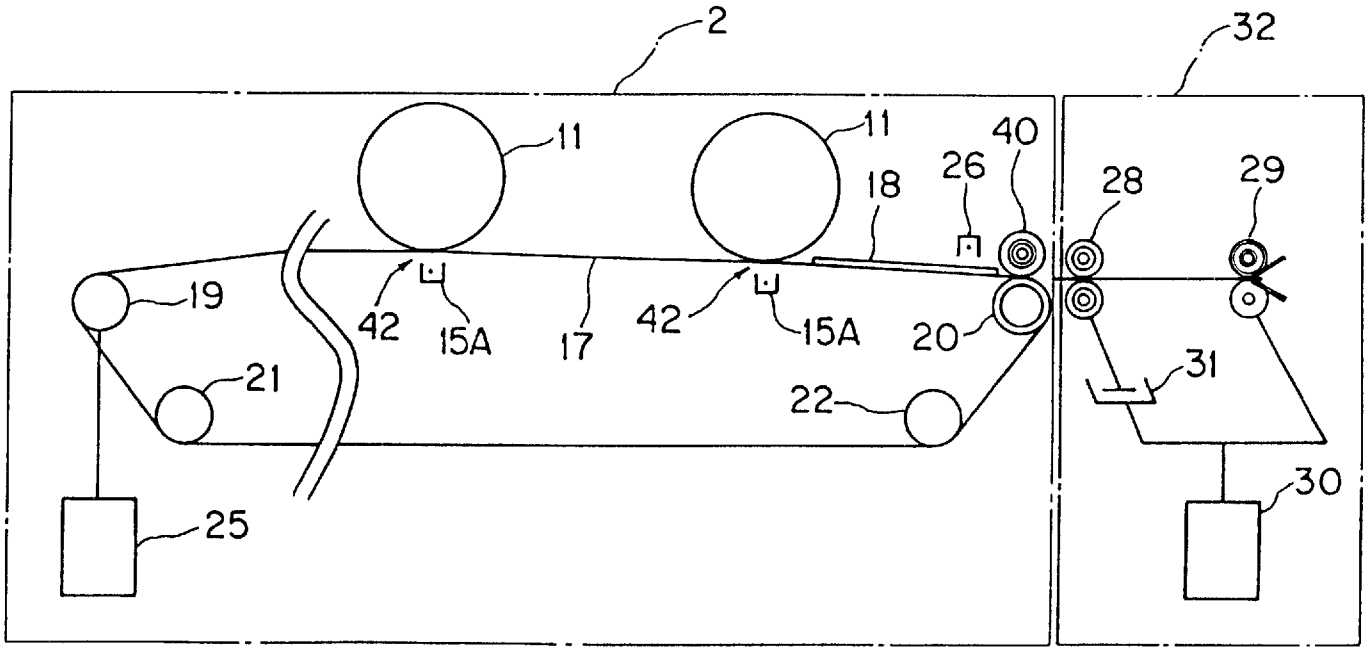
FIG. 6 is a side sectional view schematically showing the main portion of an image forming device according to a modified embodiment of the present invention.

In the above-mentioned embodiment, the example in which the transfer roller 15 is used in each of the printing units 10Y, 10M, 10C and 10K to transfer the toner image formed on the photosensitive body 11 onto the transfer paper 18 has been explained. However, instead of the transfer roller 15, the corona charger 15A may be used as shown in FIG. 6. The corona charger 15A produces the potential difference between the transfer paper 18 and the photosensitive body 11 at the image transfer point of each of the printing units 10Y, 10M, 10C and 10K by charging the transfer paper 18. Then the potential difference allows the toner image on the photosensitive body 11 to be transferred onto the transfer paper 18. In this case, the same function and effect as those in the above-mentioned embodiment can be achieved by mounting the pressure roller 40.

Figure 7:
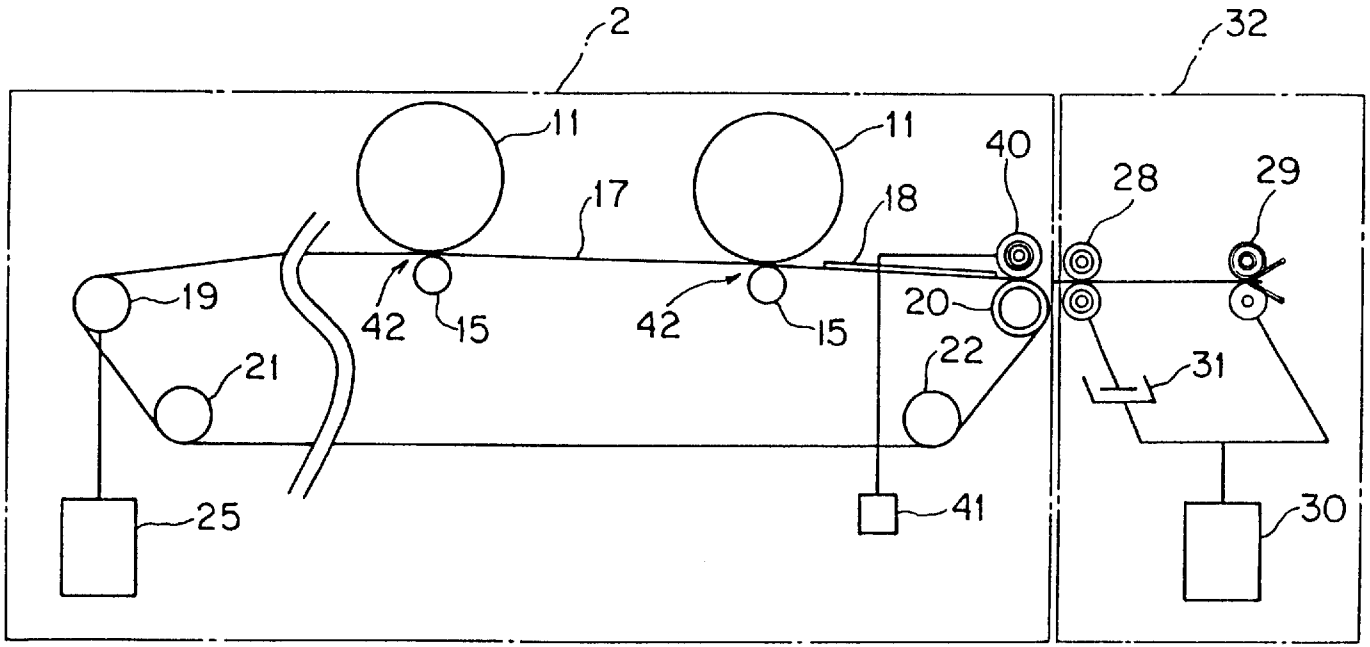
FIG. 7 is a side sectional view schematically showing the main portion of an image forming device according to another modified embodiment of the present invention.

As shown in FIG. 7, a power supply 41 that supplies the pressure roller 40 shown in FIGS. 1 to 6 can be connected and the pressure roller 40 can work as a charger that electrically charges the transfer roller 40. In this case, it is unnecessary to arrange differently the corona charger 26 (see FIGS. 1 to 6 and 9) that adsorbs the transfer paper 18 to the electrostatic adsorption belt 17. The system configuration can be simplified and slimmed.

Further, in the present embodiment, the case where the conveying system 32 is arranged upper side of the color printing engine 2 for the purpose of its high-speed operation has been explained. However, the present invention is applicable to the case where a different conveying system (such as the conveying roller 23 and the conveying guide 24) is arranged as shown in FIG. 8. Thus the same function and effect as those in the above-mentioned embodiment can be obtained.

What is claimed is:

1. An image forming device comprising:

a printing unit for performing a printing operation on a sheet-like medium by transferring a developed image on said sheet-like medium at an image transfer point;

a conveying belt for conveying said sheet-like medium along a conveying path formed so as to p ass over the image transfer point of said printing unit;

a conveying system for conveying said sheet-like medium onto said conveying belt;

a driving system for respectively driving said conveying belt and conveying system by means of different drive systems, so that transfer velocity of said sheet-like medium on said conveying belt is different from transfer velocity of said sheet-like medium on said conveying system; and a pressure roller mounted in an idle mode to one end of a lever member, said lever member having the other end rotatably supported, and near to the portion on said conveying belt where said sheet-like medium is fed from said conveying system, said pressure roller loading said conveying belt from above with the weight of said pressure roller, said sheet-like medium being transferred from said conveying system onto said conveying belt while being sandwiched between said pressure roller and said conveying belt.

2. The image forming device according to claim 1, further comprising a power supply for supplying electric power to said pressure roller; and wherein said pressure roller acts as a charger that electrically charges said sheet-like medium.

3. The image forming device according to claim 1, further comprising a plurality of printing units each of which is arranged for forming separate color images in a selected color from a plurality of colors wherein a complete color image is created by overlaying said separate color images; and wherein said conveying belt conveys said sheet-like medium along said conveying path to perform continuously a printing operation on said sheet-like medium by means of each of said printing units, said conveying path being formed continuously so as to pass over the image transfer point of each of said printing units.

4. The image forming device according to claim 3, further comprising a power supply for supplying electric power to said pressure roller; and wherein said pressure roller acts as a charger that electrically charges said sheet-like medium.

* * * * *